United States Patent [19]

Angerer

[11] Patent Number: 4,869,689

[45] Date of Patent: Sep. 26, 1989

[54] BAYONET BASE FOR A LAMP OR REFLECTOR

[75] Inventor: Reinhard Angerer, Baldham, Fed. Rep. of Germany

[73] Assignee: BLV Licht- und Vakuumtechnik GmbH, Steinhoring, Fed. Rep. of Germany

[21] Appl. No.: 205,170

[22] Filed: Jun. 10, 1988

[30] Foreign Application Priority Data

Jul. 27, 1987 [DE] Fed. Rep. of Germany ... 8710283[U]

[51] Int. Cl.[4] ..... H01K 1/18

[52] U.S. Cl. ..... 439/616

[58] Field of Search ..... 439/611–614, 439/616, 619; 313/318, 579

[56] References Cited

U.S. PATENT DOCUMENTS

| | | | |
|---|---|---|---|
| 1,848,904 | 3/1932 | Piersimoni | 439/611 X |
| 2,407,621 | 9/1946 | Weber | 439/616 X |
| 4,568,854 | 2/1986 | Westlund, Jr. et al. | 313/579 |
| 4,595,859 | 6/1986 | Steiner et al. | 313/318 X |

*Primary Examiner*—Eugene F. Desmond

*Attorney, Agent, or Firm*—Scully, Scott, Murphy & Presser

[57] ABSTRACT

A bayonet base or pedestal for a lamp or reflector which is constituted of a base member which is insertable into a bayonet socket; on which member there is arranged a socket or mounting for the lamp or the reflector, at least two terminal contact elements, and at least one latch for the locking thereof in the bayonet socket. The base or pedestal member is constructed unitarily or from a single-piece constituted of an electrically non-conductive material.

9 Claims, 2 Drawing Sheets

BAYONET BASE FOR A LAMP OR REFLECTOR

BACKGROUND OF THE INVENTION

1. Field of the Invention

The present invention relates to a bayonet base or pedestal for a lamp or a reflector which is constituted of a base member which is insertable into a bayonet socket; on which member there is arranged a socket or mounting for the lamp or the reflector, at least two terminal contact elements, and at least one latch for the locking therof in the bayonet socket.

2. Discussion of the Prior Art

Bayonet bases of this type which are currently known in the technology consist of an open metal sleeve which is provided with a non-metallic insert at the bottom of the bayonet base for purposes of insulation, whereby the lamp must be retained through the intermediary of additional inserts. Due to this configuration, there is necessitated a relatively complicated type of construction, which requires an increased demand on manufacture and assembly, and consequently leads to high manufacturing costs. Moreover, there are encountered problems with regard to surface leakage currents. The current, which under circumstances, may possibly flow in dependence upon the moisture or dampness, is quite low; however, is basically detrimental and disturbing.

SUMMARY OF THE INVENTION

Accordingly, it is a primary object to provide a bayonet base of the above-mentioned type which is configured in a manner such that, while affording a good degree of insulation, there is achieved a lesser demand on manufacture and assembly.

The foregoing object is achieved through the intermediary of a bayonet base of the type as considered herein, in which the base or pedestal member is constructed unitarily or from a single-piece constituted of an electrically non-conductive material.

In the inventive configuration or development, the bayonet base is hereby constituted unitarily or in a single-piece of an electrically non-conductive material, as a result of which the manufacturing and assembling requirements are reduced to a minimum, and the external contour of the bayonet base is essentially freed from any electrical potential. Due to the inventive development, the manufacturing costs, and also the demands on manipulation in the use of the bayonet base, can be reduced to a minimum.

The configuration pursuant to a further feature of the invention leads to the advantage that for the connection between the lamp and contacts, instead of soft or tin solder there can also be employed a hard or brazing solder, with the attending advantage of providing a higher thermal strength.

Recommended as material for the bayonet base, predicated on manufacturing and functional reasons, are plastics or ceramics, whereby the last-mentioned material is in particularly adapted to meet requirements for resistance to higher temperatures, up to about 500° C.

Pursuant to further features of the invention, there are provided advantageous measures for the construction of at least one latch, which similarly assist in the provision of a simple expedient manner of construction, whereby, in particular, there is provided a secure contacting due to the pregiven clamping latching engagement.

In accordance with further features of the invention, there is provided a simple as well as a readily manipulable and also secure connection or mounting of the lamp or the reflector, for example, with or on the bayonet base or pedestal. For this purpose, in one embodiment, the invention contemplates a suitable clamping fastening.

Due to the unitary or single-piece construction of the bayonet base, there can also be realized simple contact or terminal connections on the bayonet base for the purpose of establishing the electrical connections between the contacts of the lamp and the bayonet socket, in which the bayonet base is insertable. Hereby, the internal contacts, which are associated with the lamp, can be arranged on the internal surface of the bottom of the bayonet base and/or on the internal or casing surface of the socket plug recess in the bayonet base. In a comparable manner, the contacts which are associated with the bayonet socket can also be arranged on the external surface of the bottom of the bayonet base and/or on the jacket or casing surface of the bayonet base. Hereby, the contact connection can be formed by contact components as well as through contact terminal elements such as channels for the receipt of contact elements which extend from the lamp or also from the bayonet socket. The contacts can be constructed punctiform or distributed over the surface in the context of an axial expanse or in a ring-shaped expanse in the circumferential direction, whereby a plurality of contacts can be also arranged behind each other in the axial direction. The connecting pieces between contacts which belong to each other can hereby, in a suitable manner, be formed from metal or also from other electrically-conductive materials, such as electrically-conductive ceramic.

Thus, within the framework of the invention, it is possible to so construct the bayonet base that the lamp or the reflector is either releasably or even non-releasably retained thereon. In the second instance, the bayonet base forms a structural component, or a component grouping with the lamp and/or with another component of a structural lamp grouping, which, in particular, can be formed by a reflector for the lamp. The respective releasable attachment can be produced through adhesion or gluing, anchoring by means of a curable material such as cement, putty, or also in such a manner that a clamping action is exerted through the introduction of materials which change in their volumes. Further possibilities in providing a non-releasable clamping action are provided by pressing in or pressing-on, and the shrinking-in or shrinking-on. A further possibility for the fastening or attachment of the bayonet base on the lamp or on a reflector for the lamp consists of in that the bayonet base is formed or molded onto the lamp or onto the reflector, whereby in the last-mentioned instance, the bayonet base or pedestal can be constructed from the same material from which the lamp or the reflector is constituted.

Hereby, the contacting between the mutually interconnected structural components (bayonet base, lamp and/or reflector) can be undertaken through soldering (hard or soft), welding or brazing, clamping, riveting, crimping, screwing or glueing.

BRIEF DESCRIPTION OF THE DRAWINGS

Reference may now be had to the following detailed description of exemplary embodiments of the invention, taken in conjunction with the accompanying drawings; in which:

FIG. 6 illustrates a view turned by 90° relative to FIG. 5.

DETAILED DESCRIPTION

Figure 1:
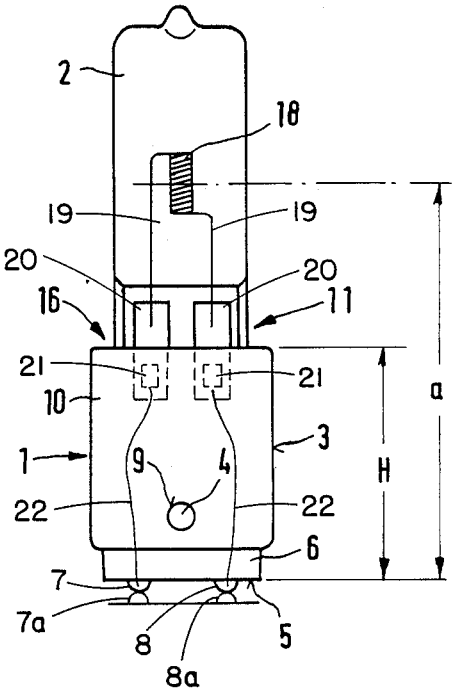
FIG. 1 illustrates a front view of an inventively developed bayonet base or pedestal with inserted lamp.
Figure 2:
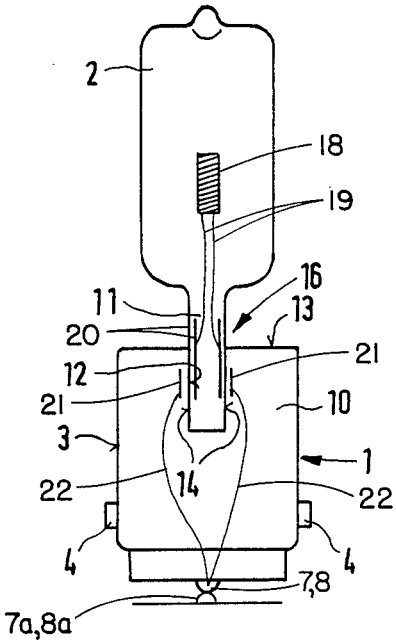
FIG. 2 illustrates a side view of the bayonet base.

The bayonet base or pedestal, which is generally identified by the reference numeral 1, is cylindrically-shaped, and in proximity to the end thereof which is distant from the lamp 2, possesses two latch attachments 4 which project radially from its mantle or casing surface 3, through which it is insertable into and latchable with a bayonet socket (not shown). Arranged at the end surface 5, of the bottom of the bayonet base 1, which is identified by reference numeral 2, are two raised contact elements 7, 8 which upon contacting fixed contacts 7*a* and 8*a*, produce an electrical connection with an electrical current supply source (not shown) in the position of the bayonet base 1 of being inserted into the bayonet socket, will provide for the electrical current circuit to the lamp 2.

The base or pedestal member 10 of the bayonet base 1 is constructed unitarily or from a single-piece, and is constituted from an electrically non-conductive material, such as a plastic or ceramic. In the present exemplary embodiment, the latches are constituted of metallic pin segments, which are inserted into radial bores 9 provided in the bayonet base 1, and retained therein through glueing or clamping. It is possible to provide a transversely through-extending bore 9, into the ends of which there are pressed-in or glued-in the latch pin segments, or there can also be provided a through-extending pin which protrudes from both ends of the casing or mantle surface 3 of the bayonet base 1 to a measure required for the necessary latching engagement.

The lamp 2 possesses a narrowed, conically or trunnion-shaped socket plug foot 11, with which it is inserted into a recess or cutout 12 in end of the bayonet base 1 opposite the contact elements 7, 8. In the present preferred exemplary embodiment, the cutout 12 is formed by a rectangular slot extending transversely through the bayonet base 1, which thereby does not only egress from the associated end surface 13, and also from the casing or mantle surface 3 of the bayonet base 1.

Within the context of the invention, it is possible that the mounting for the lamp 2 be configured as a releasable socket plug connection, or also as a permanent or non-releasable connection. For the first instance, there is preferably adapted the use of a clamp connection. Hereby, the cutout 12 is to be dimensioned such that the two opposite facing walls 14 of the cutout 12 exert a clamping action on the socket plug foot 11 of the lamp 2. However, it is also possible to fasten the lamp 2 in a fixed non-releasable manner through glueing, anchoring by means of a hardenable or curable material, puttying, shrink fitting or the like.

The electrical contacts of the lamp 2, in the inserted position thereof, are in connection with internal, contacts on the bayonet base 1. Internal electrical conduits or wires 22 lead from the contact elements 7, 8 or latch attachments 4 to contacts 21 arranged on the walls 14 of the cutout or slot 12. Located opposite thereof are contacts 20 on both surfaces of socket plug foot 11 which, in turn, are connected through wires 19 with the filament 18 of the lamp. Hereby, in the case of a socket plug connection between the bayonet base 1 and the lamp 2, this preferably pertains to the pin contacts. On the other hand, especially in the instance of a non-releasable or permanent connection, these contacts can be formed or interconnected through soldering (hard or soft), welding or brazing, clamping, riveting, crimping, screwing, or glueing.

Figure 3:
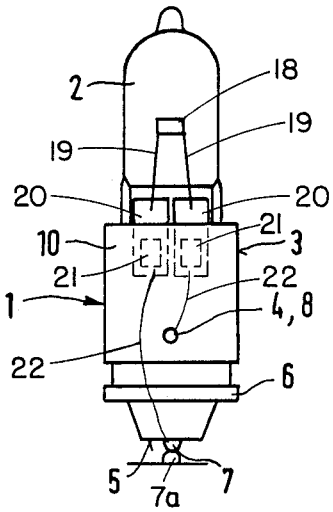
FIGS. 3 and 4 illustrate a modification of the bayonet base in, respectively, front and side views.
Figure 4:
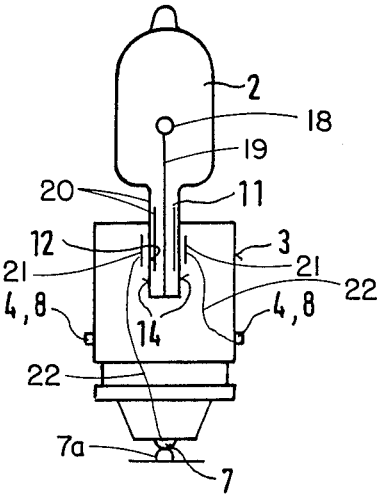

In the exemplary embodiments pursuant to FIGS. 3 and 4, the bayonet base 1 is provided at the end surface 5, of its pedestal or base 6, with only one contact element 7. The other contact element 8 is formed by at least one of the two latches 4 from an electrically-conductive metal, whereby there is produced a electrical contact connection (not shown) between the internal contacts (not shown) of the bayonet base which are in connection with the contacts of the lamp and the contacts elements 7, 8.

Figure 5:
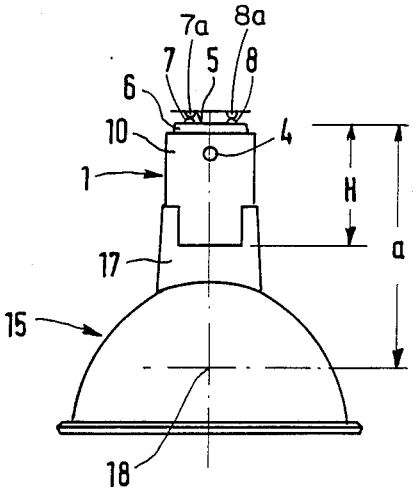
FIGS. 5 and 6 illustrate, respectively, front and side views of an inventively developed bayonet base, on which there is arranged a reflector for a lamp.
Figure 6:
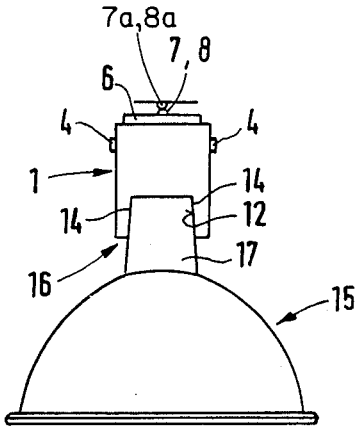

In the exemplary embodiment pursuant to FIGS. 5 and 6, instead of the lamp, a reflector 15, is connected with the bayonet pedestal or base 1 through the intermediary of a plug connection which is generally identified by reference numeral 16. For this purpose, the reflector 15 possesses a central attachment 17 on its rear side, of suitable cross-section, by means of which it is inserted into the cutout 12 or the slot in the bayonet base 1.

As has already been elucidated with respect to the first exemplary embodiment with regard to the mounting of the lamp 2, also in this connection is it possible to provide for a releasable or a fixed non-releasable connection. In the case of a releasable or detachable connection, it is recommended that the walls 14 of the cutout 12 be configured so as to be outwardly divergent, and in essence, in such a manner, that there is produced a self-locking clamping action in the position of the attachment 17 when the latter is pressed into the cutout 12. However, as in the instance of the mounting of the lamp 2, there can also be utilized a non-releasable or permanent connection through glueing, puttying, anchoring, on-or in-pressing and on-or off shrink-fitting.

The socket plug connection can also be implemented in a reverse manner; in effect, the cutout 12 can be formed in the attachment 17 and the socket plug foot 11 on the bayonet base 1.

Within the scope of the invention it is also possible to directly form or mold the bayonet base 11 on the reflector 15 or the attachment 17 thereof, or on the lamp 2. In such an instance, the bayonet base 1 is preferably constituted from the same material as the reflector 15, the attachment 17, or the lamp 2 or its plug foot 11.

In the embodiment pursuant to FIGS. 5 and 6, there is provided a mounting for the lamp (not shown), preferably a socket plug connection in the reflector 15, or in the bayonet base 1, whereby there must be provided a corresponding contact connection between the contacts of the lamp and the internal contacts of the bayonet base 1. As a result thereof, it is also possible in that instance to exchange the lamp, inasmuch as the reflector 15, and the bayonet base 1, form a unitary structural component.

For the purpose of implementing lighting centers of different intensities; in effect, different distances between the resistance wire 18, the lamp 2, and the bottom 6, of the bayonet base 1, or the bayonet socket, it is advantageous, especially in the presence of a releasable connection between the bayonet base 1, and the lamp 2, or the reflector 15, to provide a structural assembly encompassing a plurality of bayonet pedestals or bases 1, in which the lengths or the heights H, of the bayonet base 1, differ. Such a configuration is of particular significance to instances of utilization in which there is a requirement for variable illuminations.

What is claimed is:

1. A bayonet base for a lamp or for a reflector, comprising a base member which is insertable into a bayonet socket; a mounting for the lamp or the reflector, at least two contact terminal elements and at least one latch for fastening said base member in the bayonet socket, and said base member being unitarily constituted from an electrically non-conductive material, said mounting for the lamp or reflector being configured as a transversely-extending, slot-like cutout in said base member having a rectangular cross-section; at least two oppositely located non-elastic walls of said cutout diverging outwardly, and said lamp or reflector are non-releasably connected to said bayonet base through adhesion, anchoring with a curable or expandable material, puttying, shrink-fitting, pressing, clamping, molding or spraying.

2. A bayonet base as claimed in claim 1, wherein the base member is constituted of a material resistant to temperatures of up to about 500° C.

3. A bayonet base as claimed in claim 2, wherein said base member is constituted of a plastic or ceramic material.

4. A bayonet base as claimed in claim 1, wherein the latch is constituted from either metal, plastic or ceramic material.

5. A bayonet base as claimed in claim 4, wherein said latch is constituted of an electrically-conductive material forming an electrical contact and is in communication through an electrical line connection with a lamp contact on the bayonet base.

6. A bayonet base as claimed in claim 1, wherein at least two contact terminal elements are arranged in the region of the cutout and on the external surface of the end of said base member facing away from the cutout.

7. A bayonet base as claimed in claim 6, wherein the contact terminal elements comprise raised contact elements arranged on a peripheral side surface and end surface of the base member.

8. A bayonet base as claimed in claim 6, wherein operatively associated of said contact terminal elements are interconnectable through radially, axially or peripherally extending connecting members.

9. A bayonet base as claimed in claim 8, wherein the connecting members are constituted from electrically-conductive metal or electrically-conductive ceramic material.

* * * * *